US011004635B2

(12) United States Patent
Sakai et al.

(10) Patent No.: US 11,004,635 B2
(45) Date of Patent: May 11, 2021

(54) ELECTRIC CIRCUIT BREAKER DEVICE

(71) Applicant: DAICEL CORPORATION, Osaka (JP)

(72) Inventors: Toshiyuki Sakai, Tokyo (JP); Tomohide Fujiwara, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 16/639,983

(22) PCT Filed: Sep. 6, 2018

(86) PCT No.: PCT/JP2018/032963
§ 371 (c)(1),
(2) Date: Feb. 18, 2020

(87) PCT Pub. No.: WO2019/054264
PCT Pub. Date: Mar. 21, 2019

(65) Prior Publication Data

US 2020/0203102 A1 Jun. 25, 2020

(30) Foreign Application Priority Data

Sep. 15, 2017 (JP) ..... JP2017-177873

(51) Int. Cl.
*H01H 39/00* (2006.01)

(52) U.S. Cl.
CPC ..... *H01H 39/006* (2013.01); *H01H 39/00* (2013.01); *H01H 2039/008* (2013.01)

(58) Field of Classification Search
CPC . H01H 39/00; H01H 39/006; H01H 2039/008
See application file for complete search history.

(56) References Cited

U.S. PATENT DOCUMENTS 6,222,439 B1 4/2001 Tanigawa et al.
6,556,119 B1 4/2003 Lell
(Continued)

FOREIGN PATENT DOCUMENTS

JP 11-232979 A 8/1999
JP 2002-512422 A 4/2002
(Continued)

*Primary Examiner* — Jacob R Crum
(74) *Attorney, Agent, or Firm* — Birch, Stewart, Kolasch & Birch, LLP

(57) ABSTRACT

The present application relates to an electric circuit breaker device and has an object to reduce in size while maintaining a required strength. The electric circuit breaker device includes, in a resin housing (10), an igniter (20), a rod-like projectile (40), a conductor portion (50), which are disposed in this order from a first end portion (11) of the housing toward a second end portion (12) opposite the first end portion in an axial direction, and an insulating closed space (60) between the second end portion of the housing and the conductor portion, wherein the conductor portion is a plate portion including connection portions (51, 52) on both end sides; and a cut portion (53) at an intermediate portion, the conductor portion extending in a width direction orthogonal to a housing axial direction, the rod-like projectile is disposed to face the cut portion in the axial direction, and the cut portion includes fragile portions (55*a*, 55*b*) formed at two locations on the second end portion side of the conductor portion, each of the fragile portions being a notch portion.

3 Claims, 4 Drawing Sheets

(56) References Cited

U.S. PATENT DOCUMENTS

| | | | | |
|---|---|---|---|---|
| 2005/0083164 | A1 | 4/2005 | Caruso et al. | |
| 2005/0083165 | A1 | 4/2005 | Tirmizi | |
| 2007/0095554 | A1* | 5/2007 | Noda | H01H 9/042 174/55 |
| 2012/0234162 | A1 | 9/2012 | Tirmizi | |
| 2013/0175144 | A1* | 7/2013 | Sprenger | H01H 39/006 200/61.08 |
| 2013/0220095 | A1* | 8/2013 | Ukon | H01H 39/006 83/639.1 |
| 2013/0263714 | A1* | 10/2013 | Ukon | B23D 15/145 83/639.1 |
| 2014/0061161 | A1 | 3/2014 | Nakamura et al. | |
| 2017/0221662 | A1 | 8/2017 | Sakai | |

FOREIGN PATENT DOCUMENTS

| | | | |
|---|---|---|---|
| JP | 2012-156103 | A | 8/2012 |
| JP | 2014-49300 | A | 3/2014 |
| JP | 2016-85947 | A | 5/2016 |
| WO | WO 97/41582 | A1 | 11/1997 |

* cited by examiner

ELECTRIC CIRCUIT BREAKER DEVICE

TECHNICAL FIELD

The present invention relates to an electric circuit breaker device that can be used in electric circuits of vehicles, electric home appliances, and the like.

BACKGROUND ART

With regard to abnormalities and the like in electric circuits of vehicles and electric home appliances or in a system including the electric circuits, electric circuit breaker devices that break the electric circuits to prevent large damage have been used. Importance of the electric circuit breaker device is particularly large in the electric circuits of electric vehicles. The electric circuit breaker devices are known that contain an igniter, a projectile (piston), a conductor, and the like in a housing (US 2005/0083164 A, US 2005/0083165 A, US 2012/0234162 A, JP H11-232979 A, JP 2014-49300 A, JP 2016-85947 A, JP 2014-49300 A).

US 2005/0083164 A and US 2005/0083165 A exemplify a material of a housing such as metals, ceramics, and polymers and describe that certain polymers are preferable (in pages 2 to 3 of US 2005/0083164 A and page 2 of US 2005/0083165 A).

In JP H11-232979 A, a casing 13 is made of stainless steel (paragraph number 0011).

In JP 2014-49300 A, a case 30 is formed of a material having electrical insulating property and high strength (e.g., a resin material) (paragraph 0034). When a polymeric material (resin material) is used, the housing (casing) needs to be thickened in terms of imparting a required strength as can be understood from, for example, FIG. 1 of each of US 2005/0083164 A, US 2005/0083165 A, and JP 2014-49300 A. When the stainless steel casing 13 is used, the increase in mass becomes greater, and the insulating case 14 needs to be arranged in combination, so the structure and assembly are complicated.

In JP 2016-85947 A, a metallic cylinder is used to reinforce a resin housing to provide an effect that is not provided in US 2005/0083164 A, US 2005/0083165 A, US 2012/0234162 A, JP H11-232979 A, and JP 2014-49300 A.

In JP 2014-49300 A, an arc extinguishing chamber 32 for extinguishing an arc that occurs when an energized conductor is cut (in claims).

SUMMARY OF INVENTION

The present invention (first embodiment) provides an electric circuit breaker device including, in a housing made of a synthetic resin, an igniter, a rod-like projectile made of a synthetic resin, a conductor portion for forming a part of an electric circuit, which are disposed in this order from a first end portion of the housing toward a second end portion opposite to the first end portion in a housing axial direction, and an insulating closed space between the second end portion of the housing and the conductor portion, wherein the conductor portion is a plate portion including: a first connection portion and a second connection portion on both end sides; and a cut portion at an intermediate portion, the conductor portion being disposed with a surface of the cut portion being in a housing width direction orthogonal to the housing axial direction, the rod-like projectile is disposed to face the surface of the cut portion of the conductor portion in the housing axial direction, and the cut portion includes: a 1a fragile portion and a 1b fragile portion formed at two locations on the second end portion side, at an interval in the housing width direction, each of the fragile portions being a notch portion that is square or rectangular in a planar shape surrounded on three sides.

The present invention (second embodiment) provides an electric circuit breaker device including, in a housing made of a synthetic resin, an igniter, a rod-like projectile made of a synthetic resin, a conductor portion for forming a part of an electric circuit, which are disposed in this order from a first end portion of the housing toward a second end portion opposite the first end portion in a housing axial direction, and an insulating closed space between the second end portion of the housing and the conductor portion, wherein the conductor portion is a plate portion including: a first connection portion and a second connection portion on both end sides; and a cut portion at an intermediate portion, the conductor portion being disposed with a surface of the cut portion being in a housing width direction orthogonal to the housing axial direction, the rod-like projectile is disposed to face the surface of the cut portion of the conductor portion in the housing axial direction, the cut portion includes: a 2a fragile portion and a 2b fragile portion formed on a surface thereof on the first end portion side, at two locations at an interval in the housing width direction, each of the fragile portions being a notch portion that is square or rectangular in a planar shape surrounded on three sides; and a 1a fragile portion and a 1b fragile portion formed on a surface thereof on the second end portion side, at two locations at an interval in the housing width direction, each of the fragile portions being a notch portion that is square or rectangular in a planar shape surrounded on three sides, a central axis of the 2a fragile portion in the housing axial direction coincides with a central axis of the 1a fragile portion in the housing axial direction, and a central axis of the 2b fragile portion in the housing axial direction coincides with a central axis of the 1b fragile portion in the housing axial direction, and a width (W1) of the 1a fragile portion is the same as a width (W1) of the 1b fragile portion, a width (W2) of the 2a fragile portion is the same as a width (W2) of the 2b fragile portion, the widths W1 and W2 being dimensions in the housing width direction, and W1 and W2 have a relationship of $W1 \geq W2$.

BRIEF DESCRIPTION OF DRAWINGS

The present invention will be more fully understood from the detailed description given hereinbelow and the accompanying drawings, which are given for explanation only and do not limit the present invention.

DESCRIPTION OF EMBODIMENTS

Figure 1:
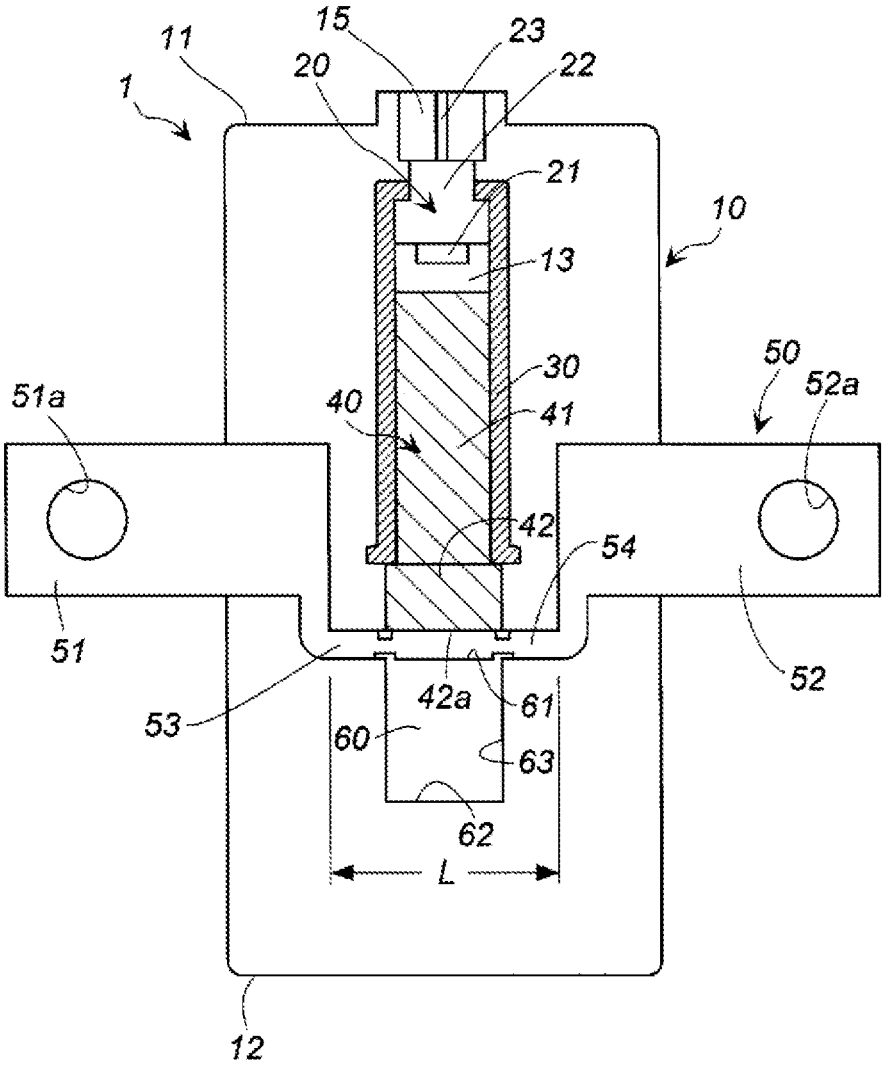
FIG. 1 is an axial direction cross-sectional view of an electric circuit breaker device according to an embodiment of the present invention.

The present invention provides an electric circuit breaker device that can be reduced in size overall while maintaining a required strength and that can extinguish an arc generated even when a conductor portion is cut.

The electric circuit breaker device according to an embodiment of the present invention can be attached to and used in electric circuits of electric vehicles, batteries of gasoline or diesel vehicles (such as lithium-ion batteries), and various electric circuits of electric home appliances and the like and can break the electric circuits when abnormalities occur in the electric circuits.

The electric circuit breaker device of the present invention can be attached alone to the various types of vehicles described above but may also be attached and actuated in conjunction with an airbag device mounted on a vehicle, for example. In such a case, when various types of vehicles on which the airbag device is mounted have accidents, leakage of large current can be prevented by making the electric circuit breaker device according to an embodiment of the present invention receive an actuation signal of the airbag device and be actuated to break the electric circuit.

The housing is made of a synthetic resin and has an external shape determined appropriately in accordance with the attachment site. The housing has a shape, structure, and size capable of accommodating and attaching components such as an igniter, a projectile, a cylinder, a conductor portion, a reinforcing frame, and the like. The housing can also include a first housing from a first end portion to a portion where a conductor portion is provided; and a second housing (bottom clip) from a portion where the conductor portion is provided to a second end portion.

Examples of the igniter include an igniter used in known electric circuit breaker devices, an igniter for a gas generator used in an airbag device of a vehicle, and the like. The igniter is provided with a conductive pin for energizing an ignition portion provided with an igniter charge, and during actuation, from an external power source, the igniter energizes and combusts the igniter charge to generate a combustion product such as combustion gas or flames.

A rod-like projectile is for receiving pressure of the combustion product generated by the actuation of the igniter, moving axially within the housing, and cutting the conductor portion to break the electric circuit. The rod-like projectile may have an entirely uniform outer diameter (uniform width) or may have an end portion larger or smaller in comparison to the other portions. The end portion of the rod-like projectile is preferably formed in a quadrangular prism shape (i.e., rectangle in a planar shape) or square in a planar shape, for the ease of cutting the rod-like projectile. The rod-like projectile can be made of the same synthetic resin as the housing. A cylinder can be disposed between the rod-like projectile and the housing as needed for reinforcing the housing.

The conductor portion can be the same as those used in known electric circuit breaker devices. The conductor portion is a plate portion including connection portions on both end sides (a first connection portion and a second connection portion) and a cut portion at an intermediate portion, and the conductor portion forms a part of the electric circuit when attached to the electric circuit. A shape of the conductor portion is a plate shape corresponding to a shape and structure of an attaching portion with respect to the housing. The conductor portion is disposed between a cylindrical space and an insulating closed space.

In the electric circuit breaker device of a first embodiment, the cut portion includes a 1a fragile portion and a 1b fragile portion formed on a surface thereof on the second end portion side, at two locations at an interval in a direction orthogonal to a housing axial direction (a housing width direction), each of the fragile portions being a notch portion that is rectangular in a planar shape.

Each of the 1a fragile portion and the 1b fragile portion is the notch portion that is square or rectangular in a planar shape surrounded on three sides because of being formed by cutting out, on three sides, each of the two locations of the plate-like cut portion on the second end portion side. Each notch portion is a cutout portion obtained by being cut out on three sides such that the cutout portion is in a rectangular or square shape, and a cutout portion cut into a shape having an oblique side such as a trapezoid or a V-shape cannot be used as the notch portion.

The electric circuit breaker device according to the first embodiment includes fragile portions that are formed, as notch portions in a specific shape, at two locations on the cut portion of the conductor portion, making it easier to cut the cut portion by the projectile during actuation. Easier cutting of the conductor portion in this manner allows an output of the igniter, for applying pressure to the projectile, to be reduced during actuation, thus leading to size reduction and further leading to reduction in the size of the housing accommodating the igniter.

In a preferred embodiment of the electric circuit breaker device according to the first embodiment, a width (W1) of the 1a fragile portion and a width (W1) of the 1b fragile portion, which are dimensions in the housing width direction, are the same as each other, and the width W1 is 5 mm or less in length.

The width (W1) of the 1a fragile portion and the width (W1) of the 1b fragile portion are preferably 5 mm or less and more preferably 2 mm or less, to suppress heat build-up upon application of a current.

In another preferred embodiment of the electric circuit breaker device according to the first embodiment, a thickness (t1) and a thickness (t2), which are dimensions in the housing axial direction, are, respectively, a thickness of a portion of the cut portion where the 1a fragile portion and the 1b fragile portion are not formed; and a thickness of a portion of the cut portion where the 1a fragile portion and the 1b fragile portion are formed. The thickness (t1) and the thickness (t2) satisfies a relationship of t2/t1=from 0.2 to 0.7.

If the relationship of t2/t1=from 0.2 to 0.7 is satisfied, the heat build-up upon the application of a current can be suppressed, which is preferable.

The insulating closed space is formed between the conductor portion and the second end portion of the housing and is opposite the cylindrical space via the conductor in the housing axial direction. The insulating closed space is a space with a cross-sectional shape of a square or rectangle in the housing width direction, corresponding to the shape of the end portion of the rod-like projectile, and has an opening portion facing the conductor portion, an closed end surface opposite the opening portion in the housing axial direction, and four side surfaces between the opening portion and the closed end surface. The opening portion of the insulating closed space faces the 1a fragile portion and the 1b fragile portion of the cut portion. Four corners are formed between the peripheral edge of the opening portion of the insulating closed space and the four side surfaces. The corners of the insulating closed space preferably face both the 1a fragile portion and the 1b fragile portion of the cut portion in the housing axial direction.

An electric circuit breaker device according to a second embodiment is the same as the electric circuit breaker device according to the first embodiment, except that the fragile portions are provided on both sides of the cut portion in the housing axial direction. The cut portion includes a 2a fragile portion and a 2b fragile portion formed on a surface thereof on the first end portion side, at two locations at an interval in the housing width direction, each of the fragile portions being the notch portion that is square or rectangular in a planar shape surrounded on three sides. Each of the 2a fragile portion and the 2b fragile portion is the notch portion that is square or rectangular in a planar shape surrounded on three sides because of being formed by cutting out, on three sides, each of the two locations of the plate-like cut portion on the first end portion side. Each notch portion is a cutout portion obtained by being cut out on three sides such that the cutout portion is in a rectangular or square shape, and a cutout portion cut into a shape having an oblique side such as a trapezoid or a V-shape cannot be used as the notch portion.

The cut portion includes a 1a fragile portion and a 1b fragile portion formed on a surface thereof on the second end portion side, at two locations at an interval in the housing width direction, each of the fragile portions being the notch portion that is square or rectangular in a planar shape surrounded on three sides. Each of the 1a fragile portion and the 1b fragile portion is the notch portion that is square or rectangular in a planar shape surrounded on three sides because of being formed by cutting out, on three sides, each of the two locations of the plate-like cut portion on the second end portion side. Each notch portion is a cutout portion obtained by being cut out on three sides such that the cutout portion is in a rectangular or square shape, and a cutout portion cut into a shape having an oblique side such as a trapezoid or a V-shape cannot be used as the notch portion.

A central axis of the 2a fragile portion in the housing axial direction coincides with a central axis of the 1a fragile portion in the housing axial direction, and a central axis of the 2b fragile portion in the housing axial direction coincides with a central axis of the 1b fragile portion in the housing axial direction. The width (W1) of the 1a fragile portion is the same as the width (W1) of the 1b fragile portion, a width (W2) of the 2a fragile portion is the same as a width (W2) of the 2b fragile portion, and W1 and W2 have a relationship of W1≥W2.

The corners of the end surface of the rod-like projectile preferably face the 2a fragile portion and the 2b fragile portion. The corners of the insulating closed space preferably face both the 1a fragile portion and the 1b fragile portion of the cut portion. A width of the end surface of the rod-like projectile is slightly smaller than the width of the opening portion of the insulating closed space.

The electric circuit breaker device according to the second embodiment includes fragile portions that are formed, as notch portions in a specific shape, at two locations on both sides of the cut portion of the conductor portion in the housing axial direction, making it easier to cut the cut portion by the projectile during actuation. Easier cutting of the conductor portion in this manner allows an output of the igniter, for applying pressure to the projectile, to be reduced during actuation, thus leading to size reduction and further leading to reduction in the size of the housing accommodating the igniter.

In a preferred embodiment of the electric circuit breaker device according to the second embodiment, the width (W1) and the width (W2), which are dimensions in the housing width direction, are, respectively, 5 mm or less in length and 5 mm or less in length.

In order to suppress the heat build-up upon the application of a current, W1 is preferably 5 mm or less and more preferably 2 mm or less, and W2 is preferably 5 mm or less and more preferably 2 mm or less.

In another preferred embodiment of the electric circuit breaker device according to the second embodiment, a thickness (t11) and a thickness (t12), which are dimensions in the housing axial direction, are, respectively, a thickness of a portion of the cut portion where the 1a fragile portion, the 1b fragile portion, the 2a fragile portion, and the 2b fragile portion are not formed; and a thickness of a portion of the cut portion where the 1a fragile portion, the 1b fragile portion, the 2a fragile portion, and the 2b fragile portion are formed. The thickness (t11) and the thickness (t12) satisfies a relationship of t12/t11=from 0.2 to 0.7.

If the relationship of t12/t11=from 0.2 to 0.7 is satisfied, the heat build-up upon the application of a current can be suppressed, which is preferable.

If the relationship of t12/t11=from 0.3 to 0.6 is satisfied, the heat build-up upon the application of a current can be suppressed, which is preferable.

The electric circuit breaker device according to an embodiment of the present invention makes it easier to cut the cut portion of the conductor portion during actuation, making it possible to use an igniter having a smaller size with a smaller output, the igniter being indirectly used for the cutting. As a result, the housing accommodating the igniter can be reduced in size, and thus the electric circuit breaker device can be also reduced in size.

Embodiments of the Invention (1) Electric Circuit Breaker Device Illustrated in FIG. 1 and FIGS. 2A and 2B An embodiment of an electric circuit breaker device 1 according to the present invention is described with reference to FIG. 1 and FIGS. 2A and 2B.

A housing (resin housing) 10 made of a synthetic resin has a cylindrical space 13 that penetrates from a first end portion 11 to a conductor portion 50 on a second end portion 12 side opposite the first end portion 11 in the axial direction. A connector fitting portion 15 connected to a power source through a lead wire during use is attached on the first end portion 11 side. In the cylindrical space 13 of the housing 10, an igniter 20, a projectile 40 made of a synthetic resin, and the conductor portion 50 are disposed in this order from the first end portion 11 side in the axial direction. The housing 10, the cylindrical space 13, the igniter 20, and the rod-like projectile 40 are arranged with their respective central axes being aligned.

The igniter 20 includes a resin portion 22 in which a portion of an igniter body including an ignition portion 21 and a conductive pin 23 is surrounded by a resin, and the ignition portion 21 protrudes from the resin portion 22.

Figure 2A:
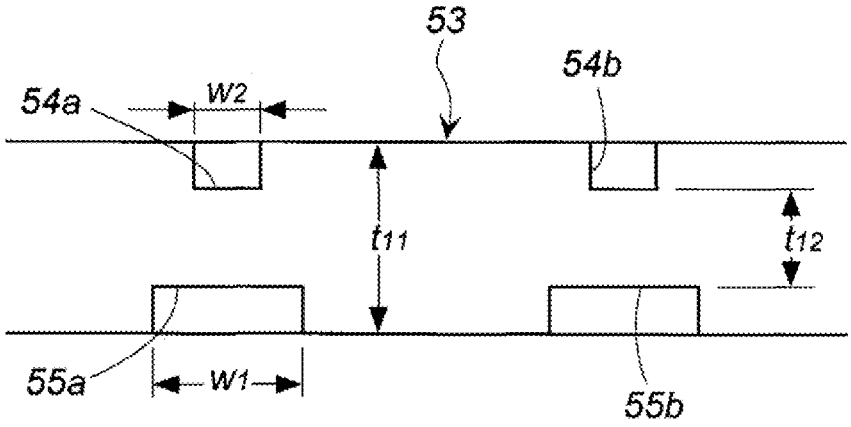
FIG. 2A and FIG. 2B are each a partial enlarged view of FIG. 1.

The rod-like projectile 40 illustrated in FIG. 1 can be the same as that illustrated in FIG. 1 and FIG. 2A of JP 2016-85947 A. The rod-like projectile 40 includes a rod portion 41 and an end increased diameter portion 42 formed on an end of the rod portion 41. An outer diameter of the end increased diameter portion 42 is greater than an outer diameter of the rod portion 41. A cross-sectional shape of the rod portion 41 in the width direction is circular, and a cross-sectional shape of the end increased diameter portion 42 in the housing width direction is square. In the rod portion 41, a recessed portion having a reduced outer diameter may be formed to fit an O-ring made of rubber (for example, silicone rubber) or synthetic resin thereto. A groove serving as a gas vent formed continuously in the axial direction may be formed between the rod portion 41 and the end increased diameter portion 42. One or two or more grooves may be formed.

A cylinder 30 illustrated in FIG. 1 is for reinforcing the housing 10 and is made of a metal such as stainless steel or aluminum; and a fiber reinforced resin such as a carbon fiber reinforced resin. A thickness of the cylinder 30 varies depending on the size of the device 1 and is preferably in a range from about 0.5 to about 3 mm. The cylinder 30 is arranged surrounding the ignition portion 21 of the igniter 20 and the rod portion 41 of the projectile 40. The cylinder 30 is press-fitted into the cylindrical space 13 to be fixed not to move in the axial direction.

The conductor portion 50 is for forming a part of an electric circuit when the device 1 is attached to the electric circuit. The conductor portion 50 is a plate portion including a first connection portion 51 and a second connection portion 52 on both end sides; and a cut portion 53 at an intermediate portion. The first connection portion 51 (a hole 51*a* of the first connection portion 51) and the second connection portion 52 (a hole 52*a* of the second connection portion 52) are for connecting to other conductors (for example, lead wires) in the electric circuit, and the cut portion 53 is to be cut for breaking the electric circuit during actuation.

The conductor portion 50 illustrated in FIG. 1 is formed to have the cut portion 53, the surface of which is orthogonal to surfaces of the first connection portion 51 and the second connection portion 52, but the surface of the cut portion 53 may be flush with the surfaces of the first connection portion 51 and the second connection portion 52. Further, the conductor portion 50 may have a portion of the first connection portion 51 near the cut portion 53; and a portion of the second connection portion 52 near the cut portion 53, both of which are deformed in the thickness direction according to the shape and structure of an attaching portion of the housing 10.

The conductor portion 50 is disposed with the surface of the cut portion 53 being in the width direction of the housing 10. The surface of the cut portion 53 of the conductor portion 50 faces an end surface 42*a* of the end increased diameter portion 42 of the rod-like projectile 40. In FIG. 1, the surfaces of the cut portion 53 and the end surface 42*a* abut each other but may face each other at a distance.

Figure 2B:
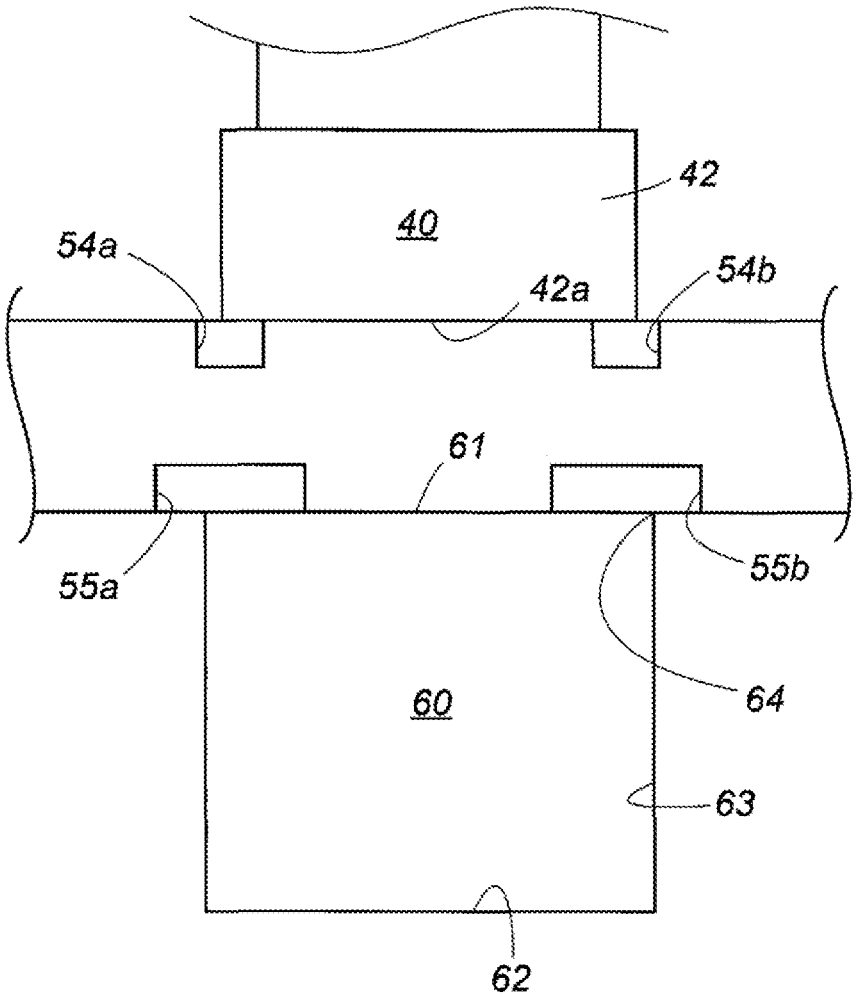

As illustrated in FIG. 1 and FIGS. 2A and 2B, the cut portion 53 includes a 1a fragile portion 55*a* and a 1b fragile portion 55*b* formed on the surface thereof on the second end portion 12 side, at two locations at an interval in the housing width direction. Each of the 1a fragile portion 55*a* and the 1b fragile portion 55*b* is formed by cutting out, on three sides, the surface of the cut portion 53 on the second end portion 12 side and is a notch portion that is square or rectangular in a planar shape surrounded on three sides after cut out. A width (W1) of the 1a fragile portion 55*a* is the same as a width (W1) of the 1b fragile portion 55*b*. W1 represents a length in the housing width direction.

The cut portion 53 includes a 2a fragile portion 54*a* and a 2b fragile portion 54*b* formed on the surface thereof on the first end portion 11 side, at two locations at an interval in the housing width direction. Each of the 2a fragile portion 54*a* and the 2b fragile portion 54*b* is formed by cutting out, on three sides, the surface of the cut portion 53 on the first end portion 11 side and is a notch portion that is square or rectangular in a planar shape surrounded on three sides after cut out. A width (W2) of the 2a fragile portion 54*a* is the same as a width (W2) of the 2b fragile portion 54*b*. W2 represents a length in the housing width direction. W1 and W2 have a relationship of W1≥W2, and W2/W1 is preferably from 0.1 to 1.0.

The width W1 is 5 mm or less in length and preferably 2 mm or less in length to suppress the heat build-up upon the application of a current, and the width W2 is 5 mm or less in length and preferably 1 mm or less in length to suppress the heat build-up upon the application of a current. Note that the length of the cut portion 53 is, in FIG. 1, a length (L in FIG. 1) from a corner (first corner) at a boundary between the cut portion 53 extending in the housing width direction and the first connection portion 51 extending in the housing axial direction to a corner (second corner) at a boundary between the cut portion 53 extending in the housing width direction and the second connection portion 52 extending in the housing axial direction.

A central axis of the 1a fragile portion 55*a* in the housing axial direction coincides with a central axis of the 2a fragile portion 54*a* in the housing axial direction, and a central axis of the 1b fragile portion 55*b* in the housing axial direction coincides with a central axis of the 2b fragile portion 54*b* in the housing axial direction.

A thickness (t11) is a thickness of a portion of the cut portion 53 where the 1a fragile portion 55*a*, the 1b fragile portion 55*b*, the 2a fragile portion 54*a*, and the 2b fragile portion 54*b* are not formed, and a thickness (t12) is a thickness of a portion of the cut portion 53 where the 1a fragile portion 55*a* and the 2a fragile portion 54*a* are formed or is a thickness of a portion of the cut portion 53 where the 1b fragile portion 55*b* and the 2b fragile portion 54*b* are formed. The thickness (t11) and the thickness (t12) satisfies a relationship of t12/t11=from 0.2 to 0.7. The thickness of the cut portion 53 is dimensions in the axial direction of the housing 10. Since the relationship of t12/t11=from 0.2 to 0.7 is satisfied, the heat build-up upon the application of a current can be suppressed. Note that, in FIGS. 2A and 2B, the 2a fragile portion 54*a* and the 2b fragile portion 54*b* may not be provided in the embodiment, and in a case of such an embodiment, t11 and t12 correspond to a thickness (t1) of the portion where the 1a fragile portion 55*a* or the 1b fragile portion 55*b* is not formed; and a thickness (t2) of the portion where the 1a fragile portion 55*a* or the 2a fragile portion 54*a* is formed, respectively.

The conductor portion 50 is disposed between the cylindrical space 13 and an insulating closed space 60, with the surface of the cut portion 53 being orthogonal to the axial direction of the housing 10. A central axis of the insulating closed space 60 coincides with the housing central axis. A width of an opening portion 61 of the insulating closed space 60 is slightly larger than a width of the cylindrical space 13 on the second end portion 12 side (a width of the end surface 42*a* of the rod-like projectile 40). The insulating closed space 60 is a space with a cross-sectional shape of a square in the housing width direction and has the opening portion 61 facing the conductor portion 50, an closed end surface 62 opposite the opening portion 61 in the housing axial direction, and four side surfaces 63 between the opening portion 61 and the closed end surface 62. The opening portion 61 of the insulating closed space 60 faces the 1a fragile portion 55*a* and the 1b fragile portion 55*b* of the cut portion 53. Four corners 64 are formed between the peripheral edge of the opening portion 61 of the insulating closed space 60 and the four side surfaces 63.

The corners 64 of the insulating closed space 60 are preferably located outward of positions in the housing width direction that coincide with the central axis of the 1a fragile portion 55*a* of the cut portion 53 in the housing axial direction (the central axis of the 2a fragile portion 54*a* in the housing axial direction); or the central axis of the 1b fragile portion 55*b* in the housing axial direction (the central axis of the 2b fragile portion 54*b* in the housing axial direction). The corners of the end surface 42*a* of the rod-like projectile 40 are preferably located outward of positions in the housing width direction that coincide with the central axis of the 2a fragile portion 54*a* of the cut portion 53 in the housing axial direction (the central axis of the 1a fragile portion 55*a* in the housing axial direction); or the central axis of the 2b fragile portion 54*b* in the housing axial direction (the central axis of the 1b fragile portion 55*b* in the housing axial direction).

Examples of a manufacturing method applicable to the electric circuit breaker device 1 illustrated in FIG. 1 include: a manufacturing method in which injection molding is performed in a state where a conductor portion is disposed in a mold, and thereafter, the necessary components are inserted from one end side of the cylindrical space 13; and a manufacturing method in which injection molding is performed in a state where a conductor portion is disposed in a mold, then the first housing from the first end portion 11 to a portion where the conductor portion 50 is provided is molded, then, injection molding is performed in a state where a resultant in which the necessary components are inserted from both end sides of the cylindrical space 13 is again disposed in the mold, and thereafter, the second housing (bottom clip) from the portion where the conductor portion 50 is provided to the second end portion 12 is molded.

Next, operations when the electric circuit breaker device 1 illustrated in FIG. 1 is disposed in a part of an electric circuit of an electric vehicle is described. The electric circuit breaker device 1 illustrated in FIG. 1 can be combined with a sensor or the like that detects an abnormal current and, for example, when an abnormal current flows to the electric circuit, can automatically initiate an operation or can also be actuated artificially.

In a case that the electric circuit breaker device 1 is disposed in the electric circuit, the lead wire constituting the electric circuit is connected to the hole 51*a* of the first connection portion 51 and the hole 52*a* of the second connection portion 52 of the conductor portion 50. When an abnormality occurs in the electric circuit, the igniter 20 operates to generate a combustion product from the ignition portion 21. Because the ignition portion 21 is surrounded on a first end opening portion 31 side of the cylinder 30, the generated combustion product travels straight within the cylinder 30 to impinge the rod portion 41 of the projectile 40.

The projectile 40 that has undergone pressure by the combustion product moves in the axial direction to cut the cut portion 53 of the conductor portion 50 by the end increased diameter portion 42. At this time, as illustrated in FIG. 1 and FIGS. 2A and 2B, each of the 1a fragile portion 55*a* and the 1b fragile portion 55*b* is a notch portion that is square or rectangular in a planar shape surrounded on three sides, and each of the 2a fragile portion 54*a* and the 2b fragile portion 54*b* is a notch portion that is square or rectangular in a planar shape surrounded on three sides. Therefore, when pressure is applied to the 2a fragile portion 54*a* and the 2b fragile portion 54*b* of the cut portion 53 by the rod-like projectile 40, a thinned portion having a uniform thickness between the 1a 55*a* and the 2a fragile portion 54*a* and a thinned portion having a uniform thickness between the 1b fragile portion 55*b* and the 2b fragile portion 54*b* are stretched to be reduced in cross-sectional areas, and thus, the cut portion 53 can be easily cut. If the 1a fragile portion 55*a*, the 1b fragile portion 55*b*, the 2a fragile portion 54*a* and the 2b fragile portion 54*b* are not rectangular and are notch portion having an oblique side such as V-shaped notch portion and trapezoidal notch portion, then even though a portion between the 1a fragile portion 55*a* and the 2a fragile portion 54*a*; and a portion between the 1b fragile portion 55*b* and the 2b fragile portion 54*b* are narrow, the thicknesses of those portions are not uniform, which is not preferable because the stretching when pressure is applied by the rod-like projectile 40 is poor and it is difficult to be cut.

Figure 3:
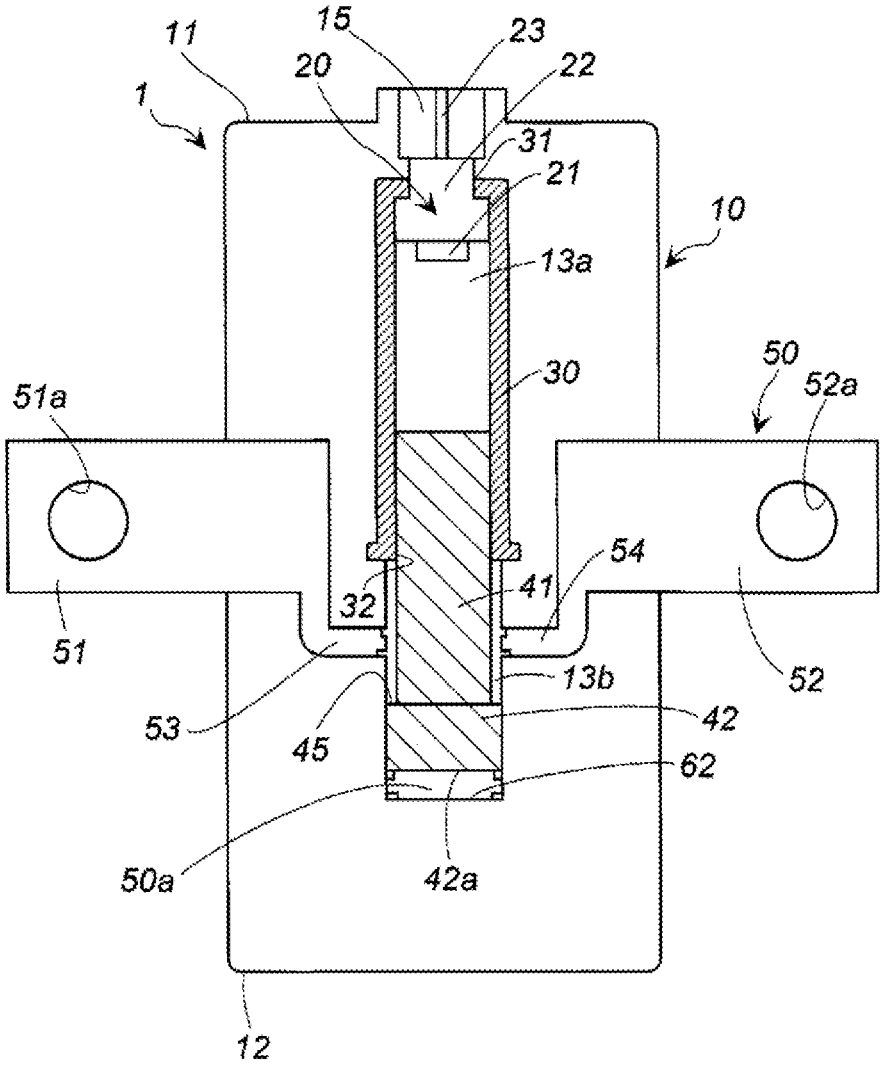
FIG. 3 is an axial direction cross-sectional view illustrating a state after the actuation of the electric circuit breaker device illustrated in FIG. 1.

Thereafter, as illustrated in FIG. 3, the end increased diameter portion 42 and a cut piece 50*a* of the cut portion 53 are moved into the insulating closed space 61 and held electrically insulated. Through this operation, the first connection portion 51 and the second connection portion 52 on both ends of the conductor portion 50 are electrically disconnected, so the electric circuit on which the device 1 is disposed is broken.

Figure 4:
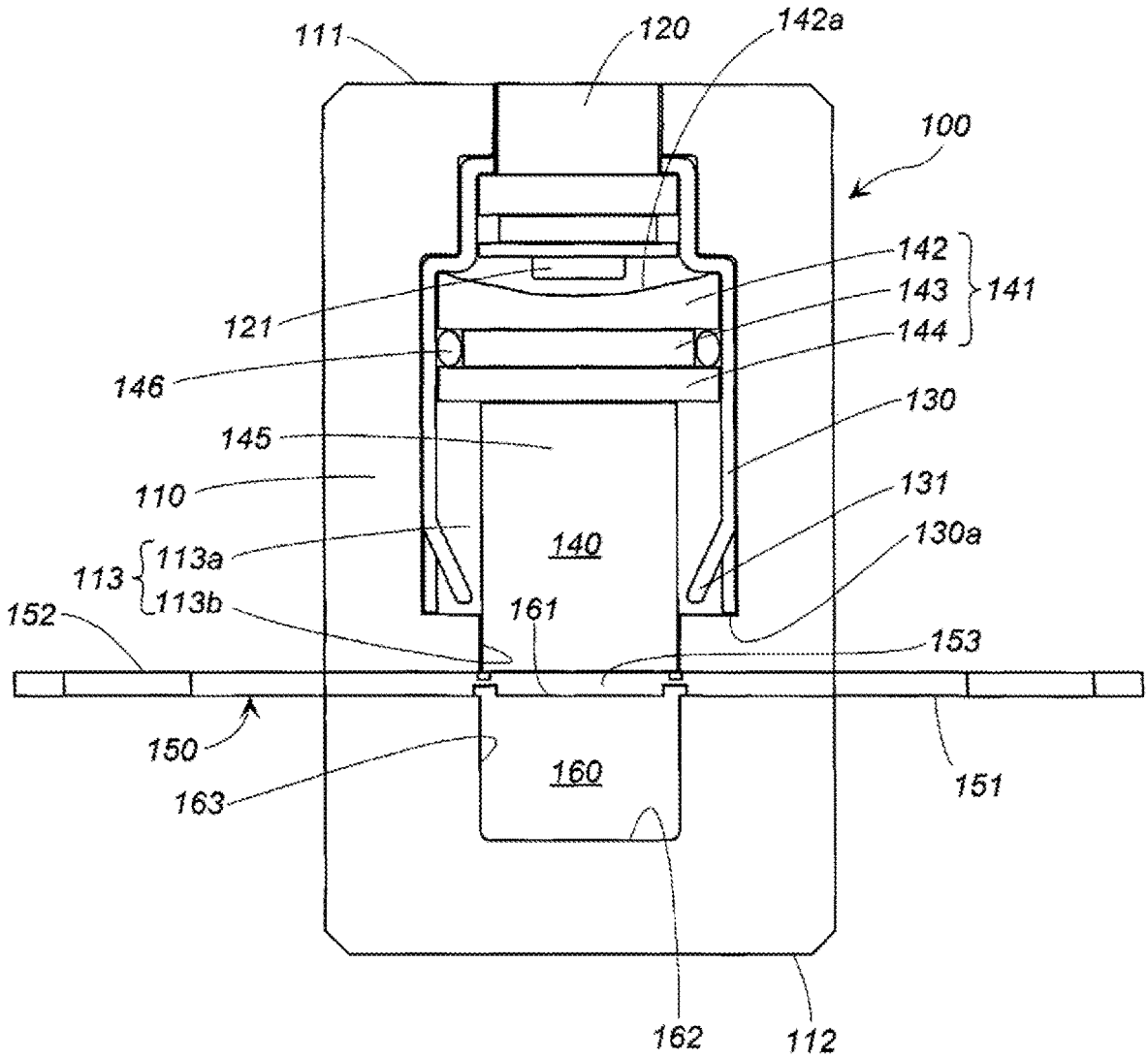
FIG. 4 illustrates a cross-sectional view of an embodiment different from the electric circuit breaker device illustrated in FIG. 1.

(2) Electric Circuit Breaker Device Illustrated in FIG. 4

An electric circuit breaker device 100 illustrated in FIG. 4 is substantially the same as the electric circuit breaker device 1 illustrated in FIG. 1, except that a shape of a rod-like projectile 140, a shape of a cylindrical space 113, and a shape of a cylinder 130 are different from the electric circuit breaker device 1 illustrated in FIG. 1.

A housing (resin housing) 110 made of a synthetic resin has a cylindrical space 113 that penetrates from a first end portion 111 to a conductor portion 150 on a second end portion 112 side. The cylindrical space 113 includes a large diameter cylindrical space 113*a* on the first end portion side and a small diameter cylindrical space 113*b* on the second end portion 112 side.

The rod-like projectile 140 includes a base portion 141 and a rod portion 145 with an outer diameter of the base portion 141 being larger than an outer diameter of the rod portion 145. A cross-sectional shape of the base portion 141 in the housing width direction is circular, and a cross-sectional shape of the rod portion 145 in the housing width direction is rectangular. The base portion 141 includes a first base portion 142 facing an igniter 120, a third base portion 144 contacting the rod portion 145, and a second base portion 143 disposed therebetween. A surface 142*a* of the first base portion 142 on the igniter 120 side has a recess portion in a curved surface shape with a center portion being the deepest and is prone to receiving the pressure generated by the igniter 120 in operation. Outer diameters of the first base portion 142 and the third base portion 144 are substantially the same and abut an inner circumferential surface of the cylinder 130. An outer diameter of the second base portion 143 is smaller than the outer diameters of the first base portion 142 and third base portion 144. Therefore, an O-ring 146 is disposed in an annular space around the second base portion 143 formed due to the difference in the outer diameter.

The cylinder 130 is for reinforcing the housing 110 and made of a metal such as stainless steel or aluminum; and a fiber reinforced resin such as a carbon fiber reinforced resin. A cross-sectional shape of the cylinder 130 in the housing width direction is circular. The cylinder 130 surrounds an ignition portion 121 of the igniter 120 and the projectile 140, and is press-fitted into the cylindrical space 113 to be fixed not to move in the axial direction. On a second end portion 130*a* side of the cylinder 130, a plurality of sets of two cuts, which are formed at a predetermined interval, are formed on a plurality of locations at an equal interval. The sets of two cuts disposed at predetermined intervals are bent inward, and thus, each bent portion functions as a guide 131 of the rod portion 145.

The conductor portion 150 is for forming a part of an electric circuit when the device 100 is attached to the electric circuit. The conductor portion 150 is a plate portion including a first connection portion 151 and a second connection portion 152 on both end sides; and a cut portion 153 at an intermediate portion. The cut portion 153 is the same as the cut portion 53 illustrated in FIGS. 2A and 2B. The first connection portion 151 and the second connection portion 152 are for connecting to other conductors (for example, lead wires) in the electric circuit, and the cut portion 153 is to be cut for breaking the electric circuit during actuation.

The conductor portion 150 is disposed with a surface of the cut portion 153 being orthogonal to the axial direction of the housing 110. The surface of the cut portion 153 of the conductor portion 150 faces an end surface of the rod portion 145 of the projectile 140. In FIG. 4, the surface of the cut portion 153 and the end surface of the rod portion 145 abut each other but may face each other at an interval.

An insulating closed space 160 is formed between the conductor portion 150 and the second end portion 112 of the housing. The insulating closed space 160 is a space with a cross-sectional shape of a square in the housing width direction and has an opening portion 161 facing the conductor portion 150, an closed end surface 162 opposite the opening portion 161 in the housing axial direction, and four side surfaces 163 between the opening portion 161 and the closed end surface 162.

Examples of a manufacturing method applicable to the electric circuit breaker device 100 illustrated in FIG. 4 include: a manufacturing method in which injection molding is performed in a state where a conductor portion is disposed in a mold, and thereafter, the necessary components are inserted from one end side of the cylindrical space 113; and a manufacturing method in which injection molding is performed in a state where a conductor portion is disposed in a mold, then the first housing from the first end portion 111 to a portion where the conductor portion 150 is provided is molded, then, injection molding is performed in a state where a resultant in which the necessary components are inserted from both end sides of the cylindrical space 113 is again disposed in the mold, and thereafter, the second housing (bottom clip) from the portion where the conductor portion 150 is provided to the second end portion 112 is molded.

When the electric circuit breaker device 100 in FIG. 4 is actuated, the electric circuit breaker device 100 operates in the same manner as the electric circuit breaker device 1 illustrated in FIG. 1 to cut the conductor portion 150, and then, the first connection portion 151 and the second connection portion 152 on both ends of the conductor portion 150 are electrically disconnected, so the electric circuit on which the device 100 is disposed is broken. At this time, the cut portion 153 has the same structure as the cut portion 53 illustrated in FIGS. 2A and 2B, and thus, is easily cut.

The electric circuit breaker device according to an embodiment of the present invention can be disposed in various electric circuits and is particularly suited for electric circuits including vehicle batteries (for example, lithium-ion batteries), for electric circuits of electric vehicles, and for electric circuits of electric home appliances.

The present invention has been described as above. Of course, the present invention includes various forms of modifications within the scope thereof, and these modifications do not depart from the scope of the invention. All of what a person with ordinary skill in the art will clearly consider as a variation of the present invention is within the scope of the claims set forth below.

The invention claimed is:

1. An electric circuit breaker device comprising:

in a housing made of a synthetic resin, an igniter, a rod-like projectile made of a synthetic resin, a conductor portion for forming a part of an electric circuit, which are disposed in this order from a first end portion of the housing toward a second end portion opposite the first end portion in a housing axial direction, and an insulating closed space between the second end portion of the housing and the conductor portion, wherein the conductor portion is a plate portion including: a first connection portion and a second connection portion on both end sides; and a cut portion at an intermediate portion, the conductor portion being disposed with a surface of the cut portion being in a housing width direction orthogonal to the housing axial direction, the rod-like projectile is disposed to face the surface of the cut portion of the conductor portion in the housing axial direction, the cut portion includes:

a 2a fragile portion and a 2b fragile portion formed on a surface thereof on the first end portion side, at two locations at an interval in the housing width direction, each of the fragile portions being a notch portion that is square or rectangular in a planar shape surrounded on three sides, and a 1a fragile portion and a 1b fragile portion formed on a surface thereof on the second end portion side, at two locations at an interval in the housing width direction, each of the fragile portions being a notch portion that is square or rectangular in a planar shape surrounded on three sides, a central axis of the 2a fragile portion in the housing axial direction coincides with a central axis of the 1a fragile portion in the housing axial direction, and a central axis of the 2b fragile portion in the housing axial direction coincides with a central axis of the 1b fragile portion in the housing axial direction, and a width (W1) of the 1a fragile portion is the same as a width (W1) of the 1b fragile portion, a width (W2) of the 2a fragile portion is the same as a width (W2) of the 2b fragile portion, the widths W1 and W2 being dimensions in the housing width direction, and W1 and W2 have a relationship of W1≥W2.

2. The electric circuit breaker device according to claim 1, wherein the W1 is 5 mm or less in length, and the W2 is 5 mm or less in length of the cut portion.

3. The electric circuit breaker device according to claim 1, wherein a thickness (t11) and a thickness (t12), which are dimensions in the housing axial direction, are, respectively, a thickness of a portion of the cut portion where the 1a fragile portion, the 1b fragile portion, the 2a fragile portion, and the 2b fragile portion are not formed; and a thickness of a portion of the cut portion where the 1a fragile portion, the 1b fragile portion, the 2a fragile portion, and the 2b fragile portion are formed, where the thickness (t11) and the thickness (t12) satisfies a relationship of t12/t11=from 0.2 to 0.7.

* * * * *